US012742603B2

(12) United States Patent
Onaka et al.

(10) Patent No.: US 12,742,603 B2
(45) Date of Patent: Sep. 22, 2026

(54) HEAT EXCHANGER AND AIR-CONDITIONING APPARATUS

(71) Applicant: Mitsubishi Electric Corporation, Tokyo (JP)

(72) Inventors: Yoji Onaka, Tokyo (JP); Tetsuji Saikusa, Tokyo (JP); Rihito Adachi, Tokyo (JP); Nanami Kishida, Tokyo (JP); Taisaku Gomyo, Tokyo (JP); Yuki Nakao, Tokyo (JP); Shingo Kasaki, Tokyo (JP); Atsushi Kibe, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 64 days.

(21) Appl. No.: 18/553,244

(22) PCT Filed: May 25, 2021

(86) PCT No.: PCT/JP2021/019807
§ 371 (c)(1),
(2) Date: Sep. 29, 2023

(87) PCT Pub. No.: WO2022/249281
PCT Pub. Date: Dec. 1, 2022

(65) Prior Publication Data

US 2024/0210132 A1 Jun. 27, 2024

(51) Int. Cl.
*F28F 17/00* (2006.01)
*F28D 1/053* (2006.01)
*F28D 21/00* (2006.01)

(52) U.S. Cl.
CPC ..... *F28F 17/005* (2013.01); *F28D 1/05391* (2013.01); *F28D 2021/007* (2013.01)

(58) Field of Classification Search
CPC ..... F28D 1/05391; F28D 2021/007; F28F 1/128; F28F 1/32; F28F 17/005; F28F 2215/08; F28F 2265/06; F28F 2265/22
See application file for complete search history.

(56) References Cited

U.S. PATENT DOCUMENTS 5,992,514 A 11/1999 Sugimoto et al.
11,009,300 B2 5/2021 Matsumoto et al.
(Continued)

FOREIGN PATENT DOCUMENTS

EP 3173725 A1 5/2017
JP 2002213840 A * 7/2002 ..... B60H 1/3233
(Continued)

OTHER PUBLICATIONS

Pdf is translation of foreign reference JP-3653909-B2 (Year: 2005).*
(Continued)

*Primary Examiner* — Len Tran
*Assistant Examiner* — Kamran Tavakoldavani
(74) *Attorney, Agent, or Firm* — Posz Law Group, PLC

(57) ABSTRACT

A heat exchanger includes a first header that extends in a horizontal direction, a plurality of first heat-transfer tubes that extend in a vertical direction, that are provided to the first header, and that are spaced from each other in a horizontal direction, a second header provided parallel to the first header, a plurality of second heat-transfer tubes that extend in a vertical direction, that are provided to the second header, and that are spaced from each other in a horizontal direction, and a corrugated fin placed between the plurality of first heat-transfer tubes and between the plurality of second heat-transfer tubes. The corrugated fin has an inter-header region between the first header and the second header, and, in the inter-header region, a first drain slit is formed through which meltwater is drained.

11 Claims, 9 Drawing Sheets

(56) References Cited

U.S. PATENT DOCUMENTS

| | | | | |
|---|---|---|---|---|
| 11,796,191 | B2 * | 10/2023 | Lee | F28F 1/30 |
| 2015/0034289 | A1 | 2/2015 | Seo et al. | |
| 2017/0082381 | A1 | 3/2017 | Sugimura et al. | |
| 2018/0328627 | A1 * | 11/2018 | Akaiwa | F28D 1/0452 |
| 2019/0049162 | A1 * | 2/2019 | Akaiwa | F25B 39/02 |
| 2020/0103148 | A1 * | 4/2020 | Matsumoto | F28D 1/053 |
| 2021/0222893 | A1 | 7/2021 | Matsui et al. | |

FOREIGN PATENT DOCUMENTS

| | | | | |
|---|---|---|---|---|
| JP | 3653909 | B2 * | 6/2005 | F28D 1/0435 |
| JP | 2015-183908 | A | 10/2015 | |
| WO | 2017/158795 | A1 | 9/2017 | |
| WO | 2019/239446 | A1 | 12/2019 | |

OTHER PUBLICATIONS

Pdf is translation of foreign reference JP-2002213840-A (Year: 2002).*

International Search Report of the International Searching Authority mailed Jul. 13, 2021 for the corresponding International Application No. PCT/JP2021/019807 (and English translation).

Office Action dated Aug. 1, 2025 issued in corresponding European patent application No. 21942937.0.

Extended European Search Report dated Jun. 14, 2024 issued in corresponding European Patent Application No. 21942937.0.

Office Action dated Mar. 13, 2026 issued in corresponding CN patent application No. 202180098351.9 (and English translation).

Decision of Rejection dated Jun. 26, 2026 issued in corresponding Chinese Patent Application No. 202180098351.9 (and English Machine Translation).

* cited by examiner

HEAT EXCHANGER AND AIR-CONDITIONING APPARATUS

CROSS-REFERENCE TO RELATED APPLICATION

This application is a U.S. National Stage Application of International Application No. PCT/JP2021/019807 filed May 25, 2021, the contents of which are incorporated herein by reference.

TECHNICAL FIELD

The present disclosure relates to an outdoor unit heat exchanger including heat-transfer tubes extending in a vertical direction and to an air-conditioning apparatus.

BACKGROUND

There has been known a heat exchanger including a plurality of columns of heat-transfer tubes extending in a vertical direction. In such a heat exchanger, a first header into which hot-gas refrigerant flows from a refrigerant circuit during a defrosting operation is provided at the bottoms of those of the plurality of heat-transfer tubes that are situated on the furthest windward side where a large amount of frost forms. The hot-gas refrigerant flowing into the first header flows through a plurality of heat-transfer tubes arranged in a row-wise direction, is subjected to heat exchange, and is brought into a liquid-phase state or a two-phase gas-liquid state. The liquid-phase or two-phase gas-liquid refrigerant flows into a turn-back header placed at upper portions of the heat-transfer tubes. The liquid-phase or two-phase gas-liquid refrigerant flowing into the turn-back header flows through a second column of a plurality of heat-transfer tubes and flows into a second header placed parallel to the first header. The hot-gas refrigerant flowing into the second header flows out from the heat exchanger.

Patent Literature

Patent Literature 1: International Publication No. 2019/239446

During the defrosting operation, such a heat exchanger may have an insufficient drain gap between the first header and the second header and may be shaped such that a large amount of meltwater from a corrugated fin flows through the gap between the first header and the second header. In this case, poor drainage of the meltwater between the first header and the second header becomes a factor for an ice gorge. In the worst case, freezing of the meltwater causes deformations in the first header and the second header and undesirably results in destruction of the heat exchanger.

SUMMARY

The present disclosure has been made in view of the circumstances and has as an object to provide a heat exchanger and an air-conditioning apparatus that do not suffer from a deformation in a header even in the event of freezing of meltwater.

A heat exchanger according to an embodiment of the present disclosure includes a first header that extends in a horizontal direction and into which hot-gas refrigerant flows during a defrosting operation, a plurality of first heat-transfer tubes that extend in a vertical direction, that are provided to the first header, that are spaced from each other in a horizontal direction, and through which the hot-gas refrigerant flowing into the first header flows, a second header provided parallel to the first header, a plurality of second heat-transfer tubes that extend in a vertical direction, that are provided to the second header, that are spaced from each other in a horizontal direction, and through which refrigerant flowing into the first header flows, and a corrugated fin placed between the plurality of first heat-transfer tubes and between the plurality of second heat-transfer tubes. The corrugated fin has an inter-header region between the first header and the second header, and, in the inter-header region, a first drain slit is formed through which meltwater is drained.

According to an embodiment of the present disclosure, the corrugated fin has an inter-header region between the first header and the second header, and, in the inter-header region, a first drain slit is formed through which meltwater is drained. Accordingly, the meltwater is drained through the first drain slit. This prevents the meltwater from freezing and makes it possible to inhibit the first header and the second header from being deformed.

DETAILED DESCRIPTION

Figure 1:
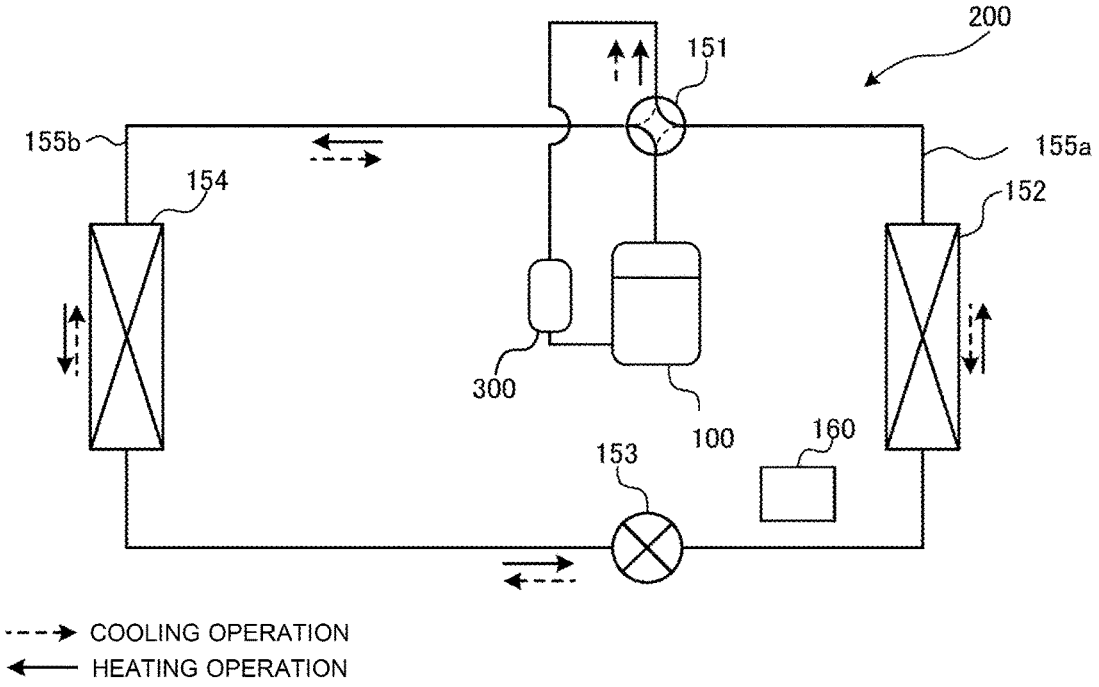
FIG. 1 is a refrigerant circuit diagram schematically showing a refrigerant circuit configuration of an air-conditioning apparatus according to Embodiment 1.

In the following, air-conditioning apparatuses according to embodiments are described with reference to the drawings. In the drawings, identical constituent elements are described with identical reference signs, and a repeated description is given only when needed. The present disclosure may encompass all combinations of combinable ones of components that are described in the following embodiments.

Embodiment 1

FIG. 1 is a refrigerant circuit diagram schematically showing a refrigerant circuit configuration of an air-conditioning apparatus 200 according to Embodiment 1. A configuration and actions of the air-conditioning apparatus 200 are described with reference to FIG. 1. The air-conditioning apparatus 200 according to Embodiment 1 is one that includes a first heat exchanger 152, which is a heat exchanger according to Embodiment 1, as one element of a refrigerant circuit.

<Configuration of Air-Conditioning Apparatus 200>

The air-conditioning apparatus 200 includes a compressor 100, a flow switching device 151, a first heat exchanger 152, an expansion device 153, and a second heat exchanger 154. The refrigerant circuit is formed by the compressor 100, the first heat exchanger 152, the expansion device 153, and the second heat exchanger 154 being connected by pipes, namely a high-pressure-side pipe 155*a* and a low-pressure-side pipe 155*b*. Further, an accumulator 300 is situated upstream of the compressor 100.

The compressor 100 is configured to suction refrigerant and compress the refrigerant into a high-temperature and high-pressure state. The refrigerant compressed by the compressor 100 is discharged from the compressor 100 and sent to the first heat exchanger 152 or the second heat exchanger 154.

The flow switching device 151 is configured to switch the flow of refrigerant between a heating operation and a cooling operation. That is, the flow switching device 151 switches between connecting the compressor 100 with the second heat exchanger 154 during the heating operation and connecting the compressor 100 with the first heat exchanger 152 during the cooling operation. It should be noted that the flow switching device 151 is preferably formed, for example, by a four-way valve. Note, however, that a combination of two-way valves or three-way valves may be employed as the flow switching device 151.

The first heat exchanger 152 serves as an evaporator during the heating operation and serves as a condenser during the cooling operation. That is, when the first heat exchanger 152 serves as an evaporator, the first heat exchanger 152 causes low-temperature and low-pressure refrigerant flowing out from the expansion device 153 and air supplied, for example, by a fan (not illustrated) to exchange heat with each other, so that low-temperature and low-pressure liquid refrigerant (or two-phase gas-liquid refrigerant) evaporates. On the other hand, when the first heat exchanger 152 serves as a condenser, the first heat exchanger 152 causes high-temperature and high-pressure refrigerant discharged from the compressor 100 and air supplied, for example, by a fan (not illustrated) to exchange heat with each other, so that high-temperature and high-pressure gas refrigerant condenses. It should be noted that the first heat exchanger 152 may be formed by a refrigerant-water heat exchanger. In this case, the first heat exchanger 152 causes refrigerant and a heat medium such as water to exchange heat with each other.

The expansion device 153 is configured to expand and decompress refrigerant flowing out from the first heat exchanger 152 or the second heat exchanger 154. The expansion device 153 is preferably formed, for example, by an electric expansion valve that is capable of adjusting the flow rate of refrigerant. As the expansion device 153, a mechanical expansion valve including a pressure sensing diaphragm, a capillary tube, or other devices, as well as an electric expansion valve, may be applied.

The second heat exchanger 154 serves as a condenser during the heating operation and serves as an evaporator during the cooling operation. That is, when the second heat exchanger 154 serves as a condenser, the second heat exchanger 154 causes high-temperature and high-pressure refrigerant discharged from the compressor 100 and air supplied, for example, by a fan (not illustrated) to exchange heat with each other, so that high-temperature and high-pressure gas refrigerant condenses. On the other hand, when the second heat exchanger 154 serves as an evaporator, the second heat exchanger 154 causes low-temperature and low-pressure refrigerant flowing out from the expansion device 153 and air supplied, for example, by a fan (not illustrated) to exchange heat with each other, so that low-temperature and low-pressure liquid refrigerant (or two-phase gas-liquid refrigerant) evaporates. It should be noted that the second heat exchanger 154 may be formed by a refrigerant-water heat exchanger. In this case, the second heat exchanger 154 causes refrigerant and a heat medium such as water to exchange heat with each other.

Further, the air-conditioning apparatus 200 is provided with a controller 160 configured to exercise overall control of the air-conditioning apparatus 200. Specifically, the controller 160 controls the driving frequency of the compressor 100 according to the required cooling capacity or heating capacity. Further, the controller 160 controls the opening degree of the expansion device 153 for each operational state and each mode. Furthermore, the controller 160 controls the flow switching device 151 according to each mode.

On the basis of an operating instruction from a user, the controller 160 controls an actuator of each of the devices such as the compressor 100, the expansion device 153, and the flow switching device 151 with reference to information sent from temperature sensors (not illustrated) and pressure sensors (not illustrated).

It should be noted that the controller 160 can be formed by hardware such as a circuit device that performs functions of the controller 160 and can be formed by an arithmetic device such as a microcomputer and a CPU and software that is run on the arithmetic device.

The controller 160 is formed by dedicated hardware or a central processing unit (CPU; also referred to as "central processor", "processing unit", "arithmetic device", "microprocessor", "microcomputer", or "processor") configured to execute programs that are stored in a memory. In a case in which the controller 160 is the dedicated hardware, the controller 160 corresponds to, for example, a single circuit, a complex circuit, an application specific integrated circuit (ASIC), a field-programmable gate array (FPGA), or a combination of these circuits and array. Functional parts that the controller 160 includes may be formed by respective separate pieces of hardware or may be formed by one piece of hardware. In a case in which the controller 160 is the CPU, functions that the controller 160 executes may be implemented by software, firmware, or a combination of the software and the firmware. The software and the firmware are described as programs and stored in the memory. The CPU implements the functions of the controller 160 by reading out and executing the programs stored in the memory. Note here that the memory is a nonvolatile or volatile semiconductor memory such as a RAM, a ROM, a flash memory, an EPROM, and an EEPROM. Some of the functions of the controller 160 may be implemented by the dedicated hardware, and others of the functions of the controller 160 may be implemented by the software or the firmware.

<Actions of Air-Conditioning Apparatus 200>

Next, actions of the air-conditioning apparatus 200 are described with reference to the flow of refrigerant. Actions of the air-conditioning apparatus 200 during the cooling operation are described here by taking as an example a case in which air serves as a heat exchange fluid at the first heat exchanger 152 and the second heat exchanger 154. In FIG. 1, the dashed arrows indicate the flow of refrigerant during the cooling operation, and the solid arrows indicate the flow of refrigerant during the heating operation.

Driving the compressor 100 causes high-temperature and high-pressure gaseous refrigerant to be discharged from the compressor 100. The high-temperature and high-pressure gas refrigerant (single-phase) discharged from the compressor 100 flows into the first heat exchanger 152. In the first heat exchanger 152, the high-temperature and high-pressure gas refrigerant flowing into the first heat exchanger 152 and air supplied by a fan (not illustrated) exchange heat with each other, so that the high-temperature and high-pressure gas refrigerant condenses into high-pressure liquid refrigerant (single-phase).

The high-pressure liquid refrigerant sent out from the first heat exchanger 152 is turned by the expansion device 153 into two-phase refrigerant including low-pressure gas refrigerant and liquid refrigerant. The two-phase refrigerant flows into the second heat exchanger 154. In the second heat exchanger 154, the two-phase refrigerant flowing into the second heat exchanger 154 and air supplied by a fan (not illustrated) exchange heat with each other, so that the liquid refrigerant included in the two-phase refrigerant evaporates into low-pressure gas refrigerant (single-phase). The low-pressure gas refrigerant sent out from the second heat exchanger 154 flows into the compressor 100 via the accumulator 300, is compressed into high-temperature and high-pressure gas refrigerant, and is discharged again from the compressor 100. Then, this cycle is repeated.

It should be noted that the actions of the air-conditioning apparatus 200 during the heating operation are executed by using the flow switching device 151 to cause refrigerant to flow as indicated by the solid arrows in FIG. 1.

It should be noted that the flow switching device 151, which is provided on a discharge side of the compressor 100, may be omitted so that refrigerant flows in a given single direction.

Figure 2:
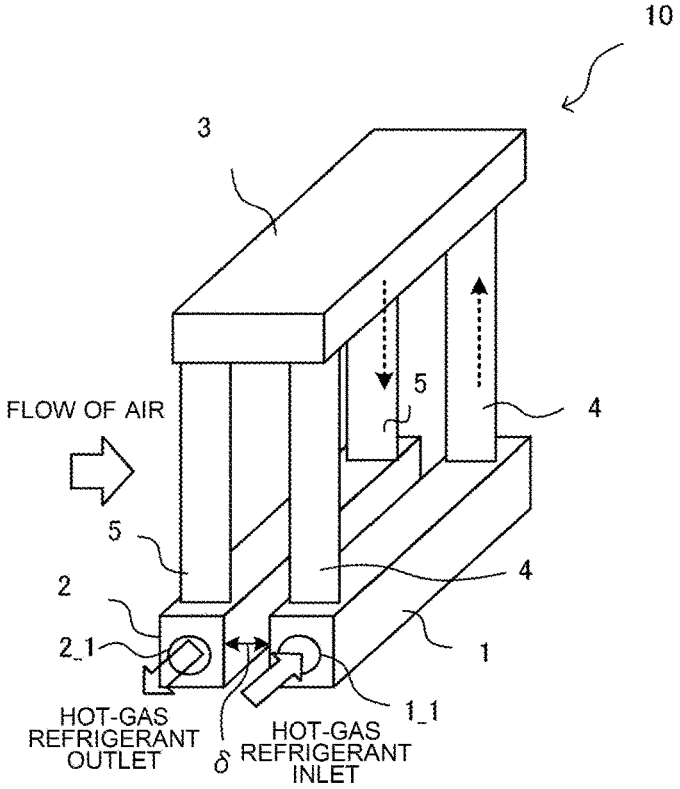
FIG. 2 is a diagram showing the external appearance of a heat exchanger of the air-conditioning apparatus according to Embodiment 1.

FIG. 2 is a diagram showing the external appearance of a heat exchanger 10 of the air-conditioning apparatus 200 according to Embodiment 1. It should be noted that the heat exchanger 10 shown in FIG. 2 is equivalent to the first heat exchanger 152 shown in FIG. 1.

<Configuration of Heat Exchanger 10>

As shown in FIG. 2, the heat exchanger 10 includes a first header 1, a second header 2, a third header 3, a plurality of first heat-transfer tubes 4, and a plurality of second heat-transfer tubes 5. The plurality of first heat-transfer tubes 4 are provided to the first header 1 and are spaced from each other in a direction of extension of the first header 1, although FIG. 2 shows only two first heat-transfer tubes 4. Similarly, the plurality of second heat-transfer tubes 5 are provided to the second header 2 and are spaced from each other in a direction of extension of the second header 2, although FIG. 2 shows only two second heat-transfer tubes 5.

The first header 1 has a hot-gas refrigerant inlet 1_1 through which hot-gas refrigerant flows in during a defrosting operation. The first header 1 has the shape of a cuboid that extends in a horizontal direction.

The plurality of first heat-transfer tubes 4 are provided in an upper surface of the first header 1 such that the plurality of first heat-transfer tubes 4 are spaced from each other in a horizontal direction and extend in a vertical direction. The hot-gas refrigerant flowing into the first header 1 flows through the plurality of first heat-transfer tubes 4. The plurality of first heat-transfer tubes 4 are flat tubes.

The second header 2 has the shape of a cuboid that extends in a horizontal direction, and is provided parallel to the first header 1. The second header 2 has a hot-gas refrigerant outlet 2_1. During the defrosting operation, the hot-gas refrigerant flows in through the hot-gas refrigerant inlet 1_1 and is condensed into liquid refrigerant or two-phase gas-liquid refrigerant and is caused to flow out from the hot-gas refrigerant outlet 2_1.

An inter-header distance between the first header 1 and the second header 2 is $\delta$ [mm].

The plurality of second heat-transfer tubes 5 are provided in an upper surface of the second header 2 such that the plurality of second heat-transfer tubes 5 are spaced from each other in a horizontal direction and extend in a vertical direction. During the defrosting operation, the hot-gas refrigerant flows into the first header 1 and is condensed into the liquid refrigerant or two-phase gas-liquid refrigerant and flows through the plurality of second heat-transfer tubes 5. The plurality of second heat-transfer tubes 5 are flat tubes.

The third header 3 has the shape of a cuboid and is provided at upper portions of the plurality of first heat-transfer tubes 4 and at upper portions of the plurality of second heat-transfer tubes 5. The liquid refrigerant or two-phase gas-liquid refrigerant into which the hot-gas refrigerant has been condensed by flowing through the plurality of first heat-transfer tubes 4 flows from the plurality of first heat-transfer tubes 4 into the third header 3. Further, the third header 3 causes the liquid refrigerant or two-phase gas-liquid refrigerant flowing in from the first heat-transfer tubes 4 to flow through the plurality of second heat-transfer tubes 5.

Figure 3:
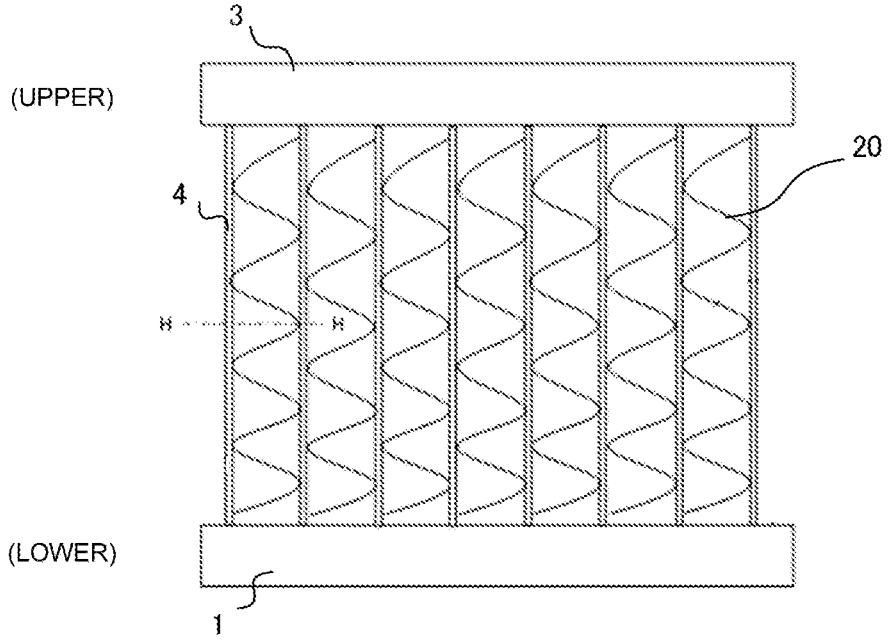
FIG. 3 is a diagram showing corrugated fins 20, which are joined to first heat-transfer tubes between a first header and a third header of the air-conditioning apparatus according to Embodiment 1.
Figure 4:
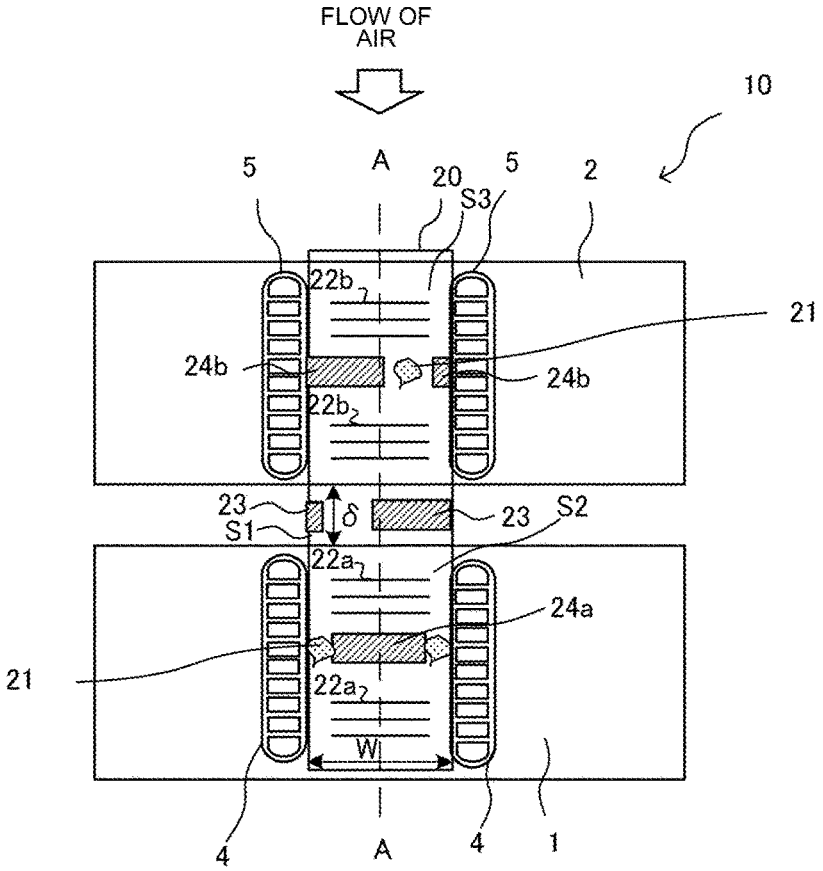
FIG. 4 is a top view of the first header, a second header, and a corrugated fin of the heat exchanger in the air-conditioning apparatus according to Embodiment 1 as seen from above.

FIG. 3 is a diagram showing corrugated fins 20, which are joined to the first heat-transfer tubes 4 between the first header 1 and the third header 3 of the air-conditioning apparatus 200 according to Embodiment 1. FIG. 4 is a top view of the first header 1, the second header 2, and a corrugated fin 20 of the heat exchanger 10 in the air-conditioning apparatus 200 according to Embodiment 1 as seen from above. In FIG. 3, when one corrugated fin 20 is virtually viewed from top (FIG. 4) in a horizontal cross-section taken along line H-H at an apex at which the corrugated fin 20 is joined to a first heat-transfer tube 4, A1 [$mm^2$] is the drain slit area of one surface of the corrugated fin 20, δ [mm] is the inter-header distance between the first header 1 and the second header 2, and W [mm] is the width of the corrugated fin 20. In this case, following formula (1) is satisfied:

$$W \times 1 \leq \delta \times W \leq A1 \quad (1)$$

Note here that δ×W is an inter-header gap area. It should be noted that the drain slit area A1 is a value obtained by combining all of the areas of a first drain slit 23, a second drain slit 24*a*, a second drain slit 24*b*, and a second drain slit 24*c* in one surface of the corrugated fin 20. The term "one surface of the corrugated fin 20" refers to one surface bridging between adjacent first heat-transfer tubes 4, that is, the surface shown in FIG. 4.

As shown in FIG. 4, a corrugated fin 20 has the shape of a rectangle as a whole when seen from above. One corrugated fin 20 has an inter-header region S1 between the first header 1 and the second header 2, a first heat-transfer tube region S2 between first heat-transfer tubes 4, and a second heat-transfer tube region S3 between second heat-transfer tubes 5.

In the inter-header region S1 of the corrugated fin 20, a first drain slit 23 is formed through which meltwater is drained. The first drain slit 23 has the shape of a rectangle and is formed parallel to a direction along long sides of the first header 1 and the second header 2.

In FIG. 4, two first drain slits 23 of different lengths in a direction parallel with the long sides of the first header 1 and the second header 2 are formed. The first drain slits 23 are provided between the first header 1 and the second header 2, and the first drain slits 23 have openings provided such that the openings partially overlap an inter-header gap between the first header 1 and the second header 2. Further, preferably, the first drain slits 23 are provided in the vicinity of the center between the first header 1 and the second header 2. The presence of such an overlap between the openings of the first drain slits 23 and the inter-header gap between the first header 1 and the second header 2 causes meltwater on the surface of the corrugated fin 20 to flow through the inter-header gap, which is a drain path between the first header 1 and the second header 2, when the meltwater flows downward under the influence of gravity.

In the first heat-transfer tube region S2, the second drain slit 24*a* is formed. As with the first drain slits 23, the second drain slit 24*a* formed in the first heat-transfer tube region S2 has the shape of a rectangle and is formed parallel to a direction along the long sides of the first header 1 and the second header 2. FIG. 4 shows a case in which second drain slits 24*a* of different lengths in a direction parallel with the long sides of the first header 1 and the second header 2 are formed. That is, the plurality of first heat-transfer tubes 4 include one first heat-transfer tube 4 and the other first heat-transfer tube 4 that is adjacent to the one first heat-transfer tube 4. The second drain slit 24*a* is provided between the one first heat-transfer tube 4 and the other first heat-transfer tube 4.

In the second heat-transfer tube region S3, a plurality of louvers 22*a* are formed parallel to a direction along the long sides of the first header 1. The plurality of louvers 22*a* connect the first heat-transfer tubes 4 with each other. The plurality of louver 22*a* include a pair of louvers 22*a*, which face each other across the second drain slit 24*a*.

In the second heat-transfer tube region S3, the second drain slit 24*b* is formed. As with the first drain slits 23, the second drain slit 24*b* formed in the second heat-transfer tube region S3 has the shape of a rectangle and is formed parallel to a direction along the long sides of the first header 1 and the second header 2. FIG. 4 shows a case in which two second drain slits 24*b* of different lengths in a direction parallel with the long sides of the first header 1 and the second header 2 are formed. That is, the plurality of second heat-transfer tubes 5 include one second heat-transfer tube 5 and the other second heat-transfer tube 5 that is adjacent to the one second heat-transfer tube 5. The second drain slit 24*b* is provided between the one second heat-transfer tube 5 and the other second heat-transfer tube 5.

In the second heat-transfer tube region S3, a plurality of louvers 22*b* are formed parallel to a direction along the long sides of the second header 2. The plurality of louvers 22*b* connect the second heat-transfer tubes 5 with each other. The plurality of louver 22*b* include a pair of louvers 22*b*, which face each other across the second drain slit 24*b*.

Figure 5:
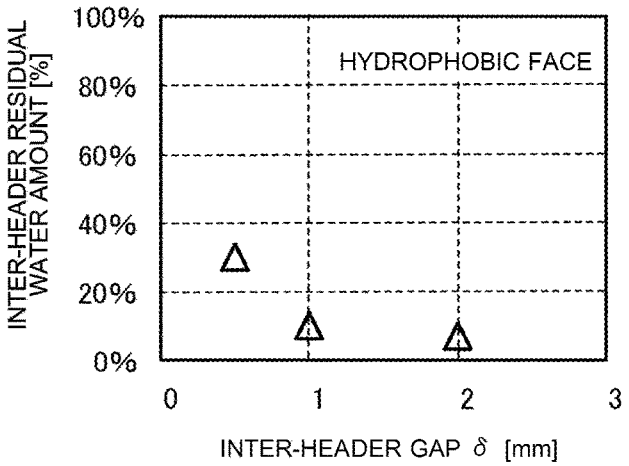
FIG. 5 is a graph showing an example of the inventors' experimental results showing a relationship between an inter-header distance $\delta$ and an inter-header residual water amount of the heat exchanger in a case in which a header surface in the air-conditioning apparatus according to Embodiment 1 is a hydrophobic face.
Figure 6:
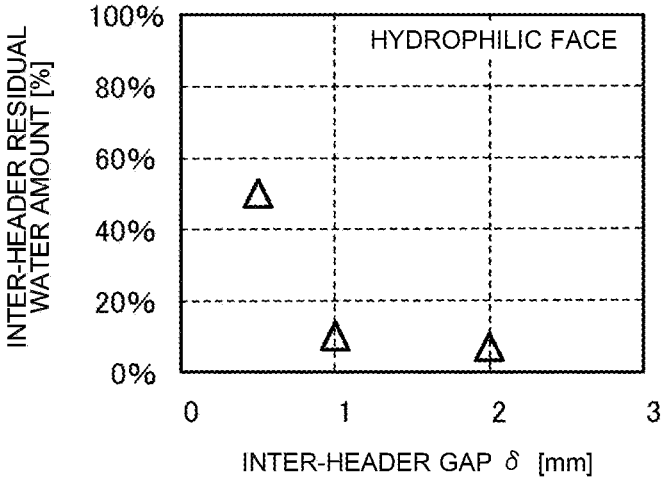
FIG. 6 is a graph showing an example of the inventors' experimental results showing a relationship between the inter-header distance $\delta$ and the inter-header residual water amount of the heat exchanger in a case in which the header surface in the air-conditioning apparatus according to Embodiment 1 is a hydrophilic face.

FIG. 5 is a graph showing an example of the inventors' experimental results showing a relationship between an inter-header distance δ and an inter-header residual water amount of the heat exchanger 10 in a case in which a header surface in the air-conditioning apparatus 200 according to Embodiment 1 is a hydrophobic face. FIG. 6 is a graph showing an example of the inventors' experimental results showing a relationship between the inter-header distance δ and the inter-header residual water amount of the heat exchanger 10 in a case in which the header surface in the air-conditioning apparatus 200 according to Embodiment 1 is a hydrophilic face.

As shown in FIG. 5, in a case in which the inter-header distance δ is 2 [mm], the inter-header residual water amount is 0.7 [%] on the hydrophobic face. In a case in which the inter-header distance δ is 1 [mm], the inter-header residual water amount is 10 [%]. In a case in which the inter-header distance δ is 0.5 [mm], the inter-header residual water amount is 30 [%].

As shown in FIG. 6, in a case in which the inter-header distance δ is 2 [mm], the inter-header residual water amount is 0.7 [%] on the hydrophilic face. In a case in which the inter-header distance δ is 1 [mm], the inter-header residual water amount is 10 [%]. In a case in which the inter-header distance δ is 0.5 [mm], the inter-header residual water amount is 50 [%].

As shown in FIGS. 5 and 6, it is found that in a case in which the inter-header distance δ is less than or equal to 1 [mm], the inter-header residual water amount sharply increases regardless of whether the header surface is a hydrophobic face or a hydrophilic face.

Figure 7:
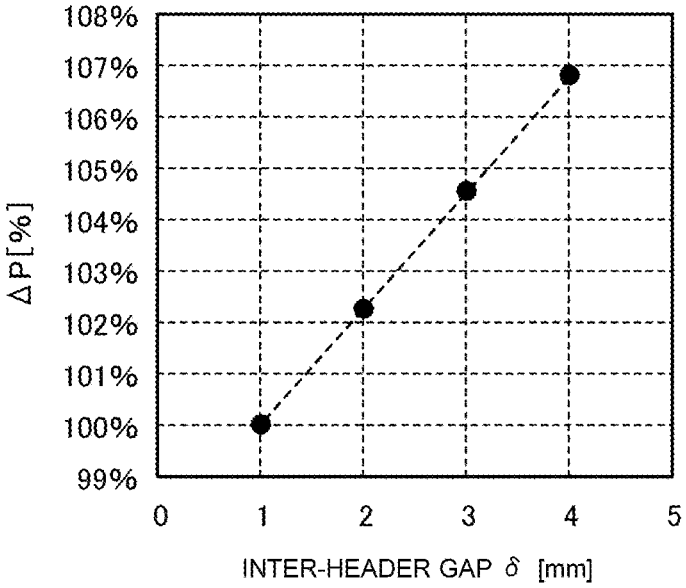
FIG. 7 is a diagram showing a relationship between the inter-header distance $\delta$ of the heat exchanger and a ventilation resistance $\Delta P$ of the heat exchanger in the air-conditioning apparatus according to Embodiment 1.
Figure 8:
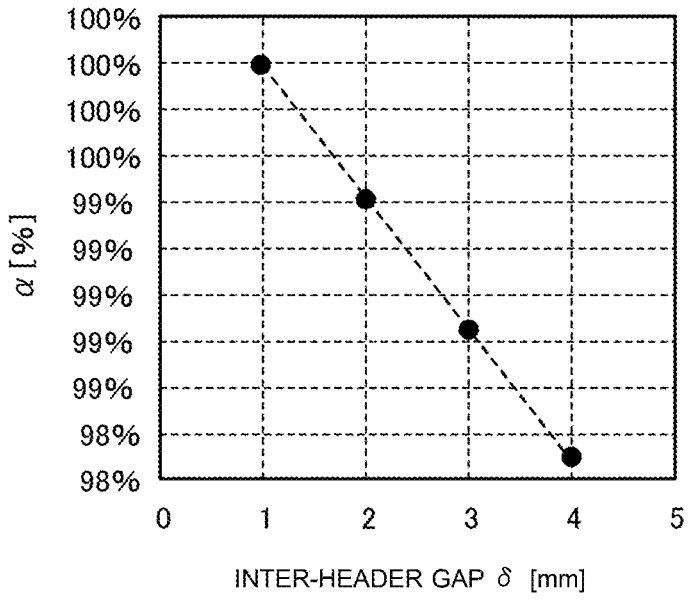
FIG. 8 is a diagram showing, based on the inventor's analyses, a relationship between the inter-header distance $\delta$ and an extratubal heat-transfer coefficient $\alpha$ of the heat exchanger in the air-conditioning apparatus according to Embodiment 1.

FIG. 7 is a diagram showing a relationship between the inter-header distance δ of the heat exchanger and a ventilation resistance ΔP of the heat exchanger 10 in the air-conditioning apparatus 200 according to Embodiment 1. FIG. 8 is a diagram showing, based on the inventor's analyses, a relationship between the inter-header distance δ and an extratubal heat-transfer coefficient α of the heat exchanger 10 in the air-conditioning apparatus 200 according to Embodiment 1.

As shown in FIG. 7, it is found that the ventilation resistance ΔP proportionately increases as the inter-header distance δ increases. Further, as shown in FIG. 8, the extratubal heat-transfer coefficient α proportionately decreases as the inter-header distance δ increases.

Figure 9:
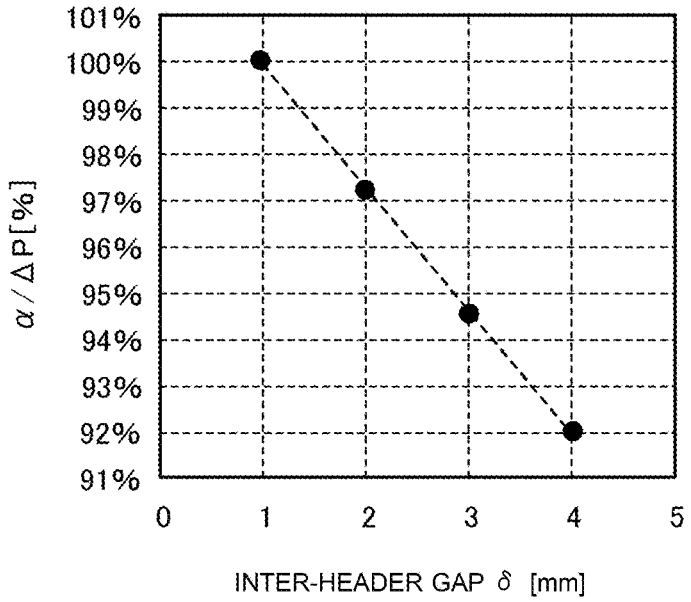
FIG. 9 is a diagram showing a relationship between the inter-header distance $\delta$ and $\alpha/\Delta P$ of the heat exchanger in the air-conditioning apparatus according to Embodiment 1.

FIG. 9 is a diagram showing a relationship between the inter-header distance δ and α/ΔP of the heat exchanger 10 in the air-conditioning apparatus 200 according to Embodiment 1. As shown in FIG. 9, α/ΔP proportionately decreases as the inter-header distance δ increases.

Figure 10:
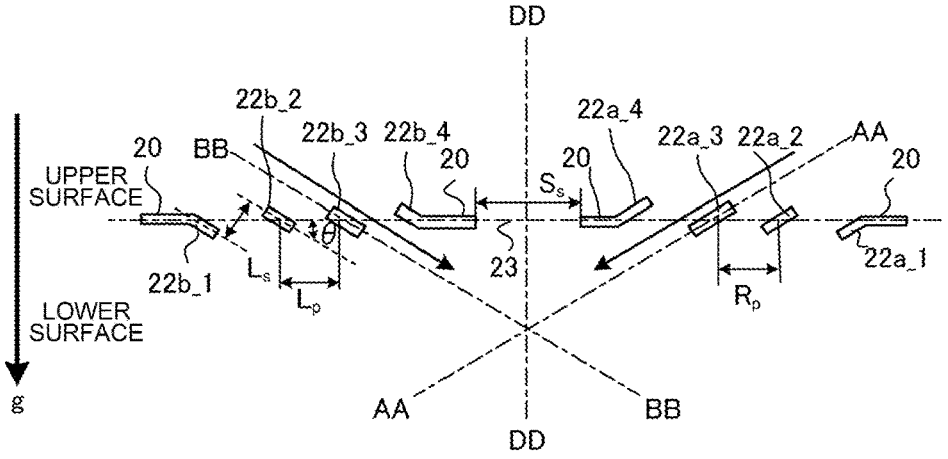
FIG. 10 is a cross-sectional view of a corrugated fin of the heat exchanger in the air-conditioning apparatus according to Embodiment 1 as horizontally taken along line A-A shown in FIG. 4.

FIG. 10 is a cross-sectional view of a corrugated fin 20 of the heat exchanger 10 in the air-conditioning apparatus 200 according to Embodiment 1 as horizontally taken along line A-A shown in FIG. 4. It should be noted that FIG. 4 shows a case in which three louvers 22*a* are formed on the right of the first drain slits 23 as seen in a direction parallel with long sides of the first drain slits 23 and three louvers 22*b* are formed on the left of the first drain slits 23 as seen in a direction parallel with the long sides of the first drain slits 23. However, the number of louvers 22*a* on the right of the first drain slits 23 and the number of louvers 22*b* on the left of the first drain slits 23 are not limited to three.

FIG. 10 shows a case in which four louvers 22*a*_1, 22*a*_2, 22*a*_3, and 22*a*_4 are formed in a corrugated fin 20 and on the right of a first drain slit 23 as seen in a direction parallel with long sides of the first drain slit 23 and four louvers 22*b*_1, 22*b*_2, 22*b*_3, and 22*b*_4 are formed in the corrugated fin 20 and on the left of the first drain slit 23 as seen in a direction parallel with the long sides of the first drain slit 23.

$L_s$ denotes the distance between the left louvers 22*b*_1 and 22*b*_2 along a louver direction, the distance between the louvers 22*b*_2 and 22*b*_3 along the louver direction, and the distance between the louvers 22*b*_3 and 22*b*_4 along the louver direction. $L_s$ is a space in which frost grows.

$R_p$ is the distance between the center of the right louver 22*a*_1 and the center of the louver 22*a*_2 in a horizontal direction, the distance between the center of the louver 22*a*_2 and the center of the louver 22*a*_3 in a horizontal direction, and the distance between the center of the louver 22*a*_3 and the center of the louver 22*a*_4 in a horizontal direction.

$L_p$ is the distance between the center of the left louver 22*b*_1 and the center of the louver 22*b*_2 in a horizontal direction, the distance between the center of the louver 22*b*_2 and the center of the louver 22*b*_3 in a horizontal direction, and the distance between the center of the louver 22*b*_3 and the center of the louver 22*b*_4 in a horizontal direction.

θ is an angle that the right lovers 22*a*_1 to 22*a*_4 and the left louvers 22*b*_1 to 22*b*_4 form with a horizontal direction. In FIG. 10, line AA-AA is a virtual auxiliary line drawn in a direction parallel with the louver 22*a*_3. Line BB-BB is a virtual auxiliary line drawn in a direction parallel with the louver 22*b*_3. The louver 22*a*_3 and the louver 22*b*_3 make a pair.

Further, the louver 22*a*_1 and the louver 22*b*_1 make a pair. The louver 22*a*_2 and the louver 22*b*_2 make a pair. The louver 22*a*_4 and the louver 22*b*_4 make a pair.

$S_s$ denotes the width of the first drain slit 23 in a horizontal direction. Line DD-DD is an auxiliary line passing through the center of the width $S_s$ of the first drain slit 23 in a horizontal direction from an upper surface to a lower surface of the corrugated fin 20.

As shown in FIG. 10, line AA-AA and line BB-BB intersect each other on the lower surface side of the corrugated fin 20. Further, line AA-AA and line BB-BB intersect line DD-DD on the lower surface side of the corrugated fin 20. That is, the corrugated fin 20 includes the pair of louvers 22*a*_3 and 22*b*_3 formed such that the pair of louvers 22*a*_3 and 22*b*_3 face each other across the first drain slit 23.

Similarly, virtual auxiliary lines drawn to lines extending along surfaces of the pair of louvers 22*a*_1 and 22*b*_1 intersect each other on the lower surface side of the corrugated fin 20. Virtual auxiliary lines drawn to lines extending along surfaces of the pair of louvers 22*a*_2 and 22*b*_2 intersect each other on the lower surface side of the corrugated fin 20. Virtual auxiliary lines drawn to lines extending along surfaces of the pair of louvers 22*a*_4 and 22*b*_4 intersect each other on the lower surface side of the corrugated fin 20.

Accordingly, the heat exchanger 10 according to Embodiment 1 causes meltwater to be drained through the first drain slit 23, thus making it possible to inhibit the first header 1 and the second header 2 from being deformed by the meltwater freezing.

Further, even in a case in which the inter-header area is smaller than the opening area of the first drain slit 23, meltwater that is retained between the first header 1 and the second header 2 can be reduced. This results in making it possible to inhibit the first header 1 and the second header 2 from being deformed. Embodiment 2.

A heat exchanger 10 of Embodiment 2 is one in which the inter-header distance δ between the first header 1 and the second header 2 is kept by forming protrusions on the first header 1 and the second header 2.

Figure 11:
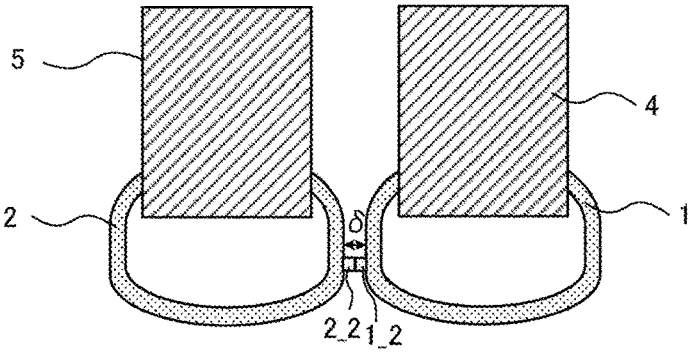
FIG. 11 is a diagram showing a first header and a second header of a heat exchanger in an air-conditioning apparatus according to Embodiment 2.
Figure 12:
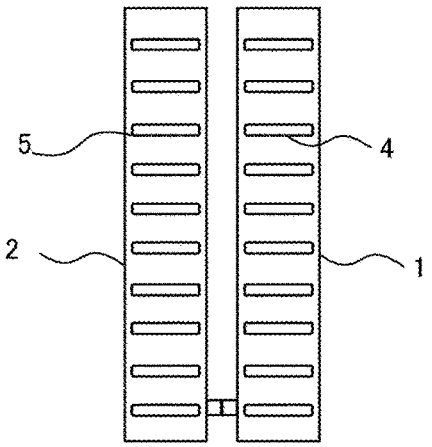
FIG. 12 is a top view of the first header and the second header of the heat exchanger in the air-conditioning apparatus according to Embodiment 2.

FIG. 11 is a diagram showing the first header 1 and the second header 2 of the heat exchanger 10 in an air-conditioning apparatus 200 according to Embodiment 2. FIG. 12 is a top view of the first header 1 and the second header 2 of the heat exchanger 10 in the air-conditioning apparatus 200 according to Embodiment 2.

As shown in FIG. 11, on a surface of the first header 1 that faces the second header 2, a rectangular first protrusion 1_2 is formed integrally with the first header 1. On a surface of the second header 2 that faces the first protrusion 1_2, a rectangular second protrusion 2_2 is formed integrally with the second header 2.

The first protrusion 1_2 and the second protrusion 2_2 are provided in positions corresponding to each other. In a case in which the first header 1 and the second header 2 are placed, the first protrusion 1_2 and the second protrusion 2_2 are in contact with each other, and the length of the first protrusion 1_2 and the second protrusion 2_2 in contact with each other in a horizontal direction is the inter-header distance δ. This causes the inter-header distance, which is the distance between the first header 1 and the second header 2, to be δ.

The number of first protrusions 1_2 and the number of second protrusions 2_2 may be plural, although a case has been described in which one first protrusion 1_2 is formed on the first header 1 and one second protrusion 2_2 is formed on the second header 2.

Accordingly, the heat exchanger 10 according to Embodiment 2 has the first protrusion 1_2 formed on the first header 1 and the second protrusion 2_2 formed on the second header 2. This makes it possible to secure the inter-header distance δ between the first header 1 and the second header 2. This results in making it possible to inhibit the first header 1 and the second header 2 from being damaged by an ice gorge.

Embodiment 3

A heat exchanger 10 of Embodiment 3 is one in which the inter-header distance δ between the first header 1 and the second header 2 is kept by providing a positioning element between the first header 1 and the second header 2.

Figure 13:
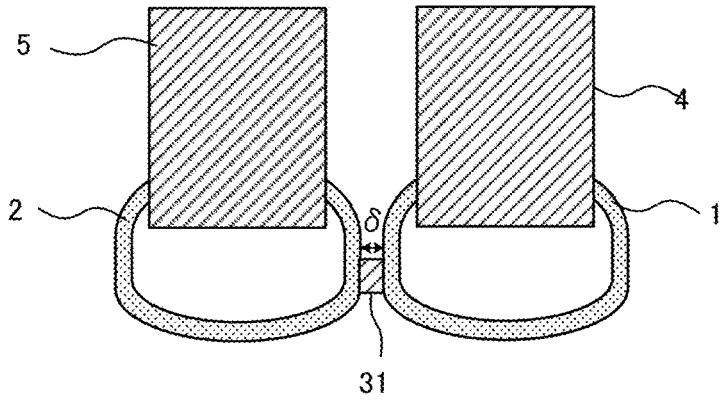
FIG. 13 is a diagram showing a first header, a second header, and a positioning element of a heat exchanger in an air-conditioning apparatus according to Embodiment 3.
Figure 14:
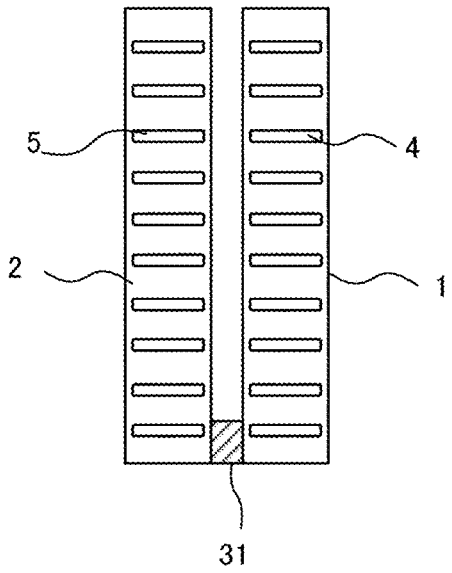
FIG. 14 is a top view of the first header, the second header, and the positioning element of the heat exchanger in the air-conditioning apparatus according to Embodiment 3.

FIG. 13 is a diagram showing the first header 1, the second header 2, and a positioning element 31 of the heat exchanger 10 in an air-conditioning apparatus 200 according to Embodiment 3. FIG. 14 is a top view of the first header 1, the second header 2, and the positioning element 31 of the heat exchanger 10 in the air-conditioning apparatus 200 according to Embodiment 3.

As shown in FIG. 13, the positioning element 31 is provided between the first header 1 and the second header 2. The positioning element 31 has the shape of a rectangle having long sides extending in the directions of extension of the first header 1 and the second header 2, and the width of a short side of the positioning element 31 is the inter-header distance δ. The positioning element 31 is one that keeps the inter-header distance δ between the first header 1 and the second header 2. The positioning element 31 is made of resin or a carbon sheet.

It should be noted that a plurality of the positioning elements 31 may be provided between the first header 1 and the second header 2.

Accordingly, the heat exchanger 10 according to Embodiment 3 has the positioning element 31 provided between the first header 1 and the second header 2. This makes it possible to secure the inter-header distance δ between the first header 1 and the second header 2. This results in making it possible to inhibit the first header 1 and the second header 2 from being damaged by an ice gorge.

Embodiment 4

A heat exchanger 10 according to Embodiment 4 has a plurality of headers integrally formed and a drain slit provided between a flow passage of each header and a flow passage of an adjacent header.

Figure 15:
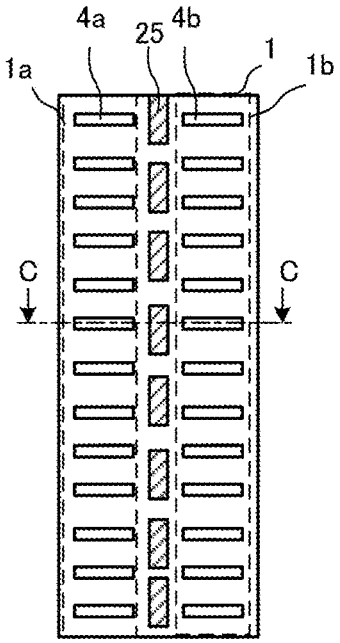
FIG. 15 is a top view of a first header of a heat exchanger in an air-conditioning apparatus according to Embodiment 4 as seen from above.
Figure 16:
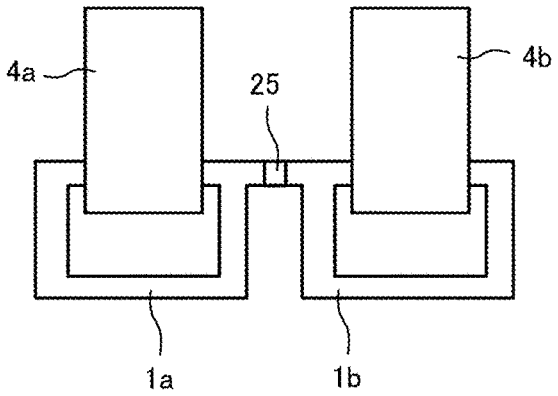
FIG. 16 is a diagram showing a horizontal cross-section of the heat exchanger 10 in the air-conditioning apparatus according to Embodiment 4 as taken along line C-C shown in FIG. 15.

FIG. 15 is a top view of the first header 1 of the heat exchanger 10 in an air-conditioning apparatus 200 according to Embodiment 4 as seen from above. FIG. 16 is a diagram showing a horizontal cross-section of the heat exchanger 10 in the air-conditioning apparatus 200 according to Embodiment 4 as taken along line C-C shown in FIG. 15.

As shown in FIG. 15, the first header 1 includes a first header 1*a* and a first header 1*b*, which are integrally formed.

The first header 1*a* has a hot-gas refrigerant inlet through which hot-gas refrigerant flows in during a defrosting operation. The first header 1*a* has the shape of a cuboid that extends in a horizontal direction. The first header 1*b* is provided parallel to the first header 1*a* and has a hot-gas refrigerant inlet through which hot-gas refrigerant flows in during a defrosting operation. The first header 1*b* has the shape of a cuboid that extends in a horizontal direction.

A plurality of first heat-transfer tubes 4*a* are provided in an upper surface of the first header 1*a* such that the plurality of first heat-transfer tubes 4*a* are spaced from each other in a horizontal direction and extend in a vertical direction. The hot-gas refrigerant flowing into the first header 1*a* flows through the plurality of first heat-transfer tubes 4*a*. The plurality of first heat-transfer tubes 4*a* are flat tubes. A plurality of first heat-transfer tubes 4*b* are provided in an upper surface of the first header 1*b* such that the plurality of first heat-transfer tubes 4*b* are spaced from each other in a horizontal direction and extend in a vertical direction. The hot-gas refrigerant flowing into the first header 1*b* flows through the plurality of first heat-transfer tubes 4*b*. The plurality of first heat-transfer tubes 4*b* are flat tubes.

A third drain slit 25 is provided between the first header 1*a* and the first header 1*b*. The third drain slit 25 allows drainage of meltwater from the first heat-transfer tubes 4*a* and the first heat-transfer tubes 4*b*. The third drain slit 25 has the shape of a rectangle whose long sides extend in a direction orthogonal to a horizontal direction and a direction of extension of the first heat-transfer tubes 4*a*. As shown in FIG. 15, the third drain slit 25 is placed between one first header 1*a* and one first header 1*b* or between two first headers 1*a* and two first headers 1*b*.

It should be noted that also in a case in which the second header 2 includes a plurality of headers, a configuration that is similar to that in which the first header 1 includes a plurality of headers can be employed. Further, although Embodiment 4 has shown a case in which the first header 1 includes the first header 1*a* and the first header 1*b*, the number of first headers is not limited to two but may be larger than or equal to three.

Further, the first header 1*a* is also referred to as "fourth header", and the first header 1*b* is also referred to as fifth header".

Accordingly, the heat exchanger 10 according to Embodiment 4 makes it possible to form a heat exchanger at low cost, as the first header 1*a* and the first header 1*b* can be integrally formed. Further, providing the third drain slit 25 makes it possible to insulate heat of a flow passage of the first header 1*a* and heat of a flow passage of the first header 1*b* from each other. This makes it possible to thermally reduce heat leakage between the first header 1*a* and the first header 1*b*. At this time, making the gap of the third drain slit 25 greater than or equal to 1 mm more preferably makes it possible to reduce residual meltwater.

The embodiments have been presented as examples and are not intended to limit the scope of the claims. The embodiments may be carried out in other various forms, and various omissions, substitutions, and changes can be made without departing from the gist of the embodiments. These embodiments and modifications of these embodiments are encompassed in the scope and gist of the embodiments.

The invention claimed is:

1. A heat exchanger comprising:

a first header that extends in a horizontal direction and into which hot-gas refrigerant flows during a defrosting operation;

a plurality of first heat-transfer tubes that extend in a vertical direction, that are provided to the first header, that are spaced from each other in a horizontal direction, and through which the hot-gas refrigerant flowing into the first header flows;

a second header provided parallel to the first header;

a plurality of second heat-transfer tubes that extend in a vertical direction, that are provided to the second header, that are spaced from each other in a horizontal direction, and through which refrigerant flowing into the first header flows; and a corrugated fin placed between the plurality of first heat-transfer tubes and between the plurality of second heat-transfer tubes, the corrugated fin having an inter-header region between the first header and the second header, in the inter-header region, a first drain slit being formed through which meltwater is drained, the corrugated fin having a second drain slit that is formed in a first heat-transfer tube region between the plurality of first heat-transfer tubes and a second heat-transfer tube region between the plurality of second heat-transfer tubes and through which the meltwater is drained, $W \times 1 \leq \delta \times W \leq A1$ being satisfied, where A1 is a combined area of the first drain slit and the second drain slit per surface of the corrugated fin, $\delta$ is an inter-header distance between the first header and the second header, 1 represents a unit of length, and W is a width of the corrugated fin.

2. The heat exchanger of claim 1, wherein the first drain slit is provided in a center between the first header and the second header.

3. The heat exchanger of claim 1, wherein the plurality of first heat-transfer tubes include one first heat-transfer tube and an other first heat-transfer tube that is adjacent to the one first heat-transfer tube, and the second drain slit is provided between the one first heat-transfer tube and the other first heat-transfer tube.

4. The heat exchanger of claim 1, wherein the plurality of second heat-transfer tubes include one second heat-transfer tube and an other second heat-transfer tube that is adjacent to the one second heat-transfer tube, and the second drain slit is provided between the one second heat-transfer tube and the other second heat-transfer tube.

5. The heat exchanger of claim 1, wherein the first header has a first protrusion formed on a surface of the first header that faces the second header, the second header has a second protrusion formed on a surface of the second header that faces the first protrusion, and the first protrusion and the second protrusion are in contact with each other and an inter-header distance is thus kept that is a distance between the first header and the second header.

6. The heat exchanger of claim 1, wherein the first header includes a fourth header that extends in a horizontal direction and into which the hot-gas refrigerant flows during the defrosting operation and a fifth header that is provided parallel to the fourth header and into which the hot-gas refrigerant flows during the defrosting operation, and the fourth header and the fifth header are integrally formed with a third drain slit formed between the fourth header and the fifth header.

7. The heat exchanger of claim 1, further comprising a third header that is provided at upper portions of the plurality of first heat-transfer tubes and at upper portions of the plurality of second heat-transfer tubes, into which liquid refrigerant or two-phase gas-liquid refrigerant into which the hot-gas refrigerant condensed by flowing through the plurality of first heat-transfer tubes flows from the plurality of first heat-transfer tubes, and through which the liquid refrigerant or the two-phase gas-liquid refrigerant flowing from the plurality of first heat-transfer tubes flows to the plurality of second heat-transfer tubes.

8. An air-conditioning apparatus comprising the heat exchanger of claim 1.

9. A heat exchanger comprising:

a first header that extends in a horizontal direction and into which hot-gas refrigerant flows during a defrosting operation;

a plurality of first heat-transfer tubes that extend in a vertical direction, that are provided to the first header, that are spaced from each other in a horizontal direction, and through which the hot-gas refrigerant flowing into the first header flows;

a second header provided parallel to the first header;

a plurality of second heat-transfer tubes that extend in a vertical direction, that are provided to the second header, that are spaced from each other in a horizontal direction, and through which refrigerant flowing into the first header flows; and a corrugated fin placed between the plurality of first heat-transfer tubes and between the plurality of second heat-transfer tubes, the corrugated fin having an inter-header region between the first header and the second header, in the inter-header region, a first drain slit being formed through which meltwater is drained, the corrugated fin including a first pair of louvers and a second set of louvers, the first pair of louvers is formed on a first side of the first drain slit and are configured to angle downward toward the first drain slit, the second pair of louvers is formed on a second side of the first drain slit opposite the first side and are configured to angle downward toward the first drain slit, and virtual auxiliary lines drawn to lines extending along surfaces of the pair of louvers intersecting each other on a lower surface side of the corrugated fin.

10. A heat exchanger comprising:

a first header that extends in a horizontal direction and into which hot-gas refrigerant flows during a defrosting operation;

a plurality of first heat-transfer tubes that extend in a vertical direction, that are provided to the first header, that are spaced from each other in a horizontal direction, and through which the hot-gas refrigerant flowing into the first header flows;

a second header provided parallel to the first header;

a plurality of second heat-transfer tubes that extend in a vertical direction, that are provided to the second header, that are spaced from each other in a horizontal direction, and through which refrigerant flowing into the first header flows; and a corrugated fin placed between the plurality of first heat-transfer tubes and between the plurality of second heat-transfer tubes, the corrugated fin having an inter-header region between the first header and the second header, in the inter-header region, a first drain slit being formed through which meltwater is drained, the heat exchanger comprising a positioning element that is provided between the first header and the second header and that keeps a distance between the first header and the second header.

11. The heat exchanger of claim 10, wherein the positioning element contacts both the first header and the second header such that the positioning element keeps the distance between the first header and the second header.

* * * * *